US009358695B2

(12) United States Patent
Baba et al.

(10) Patent No.: US 9,358,695 B2
(45) Date of Patent: Jun. 7, 2016

(54) TRIMMER APPARATUS

(71) Applicants: Kenji Baba, Kofu (JP); Chiaki Osada, Nirasaki (JP); Hirokazu Tanaka, Minami-Alps (JP)

(72) Inventors: Kenji Baba, Kofu (JP); Chiaki Osada, Nirasaki (JP); Hirokazu Tanaka, Minami-Alps (JP)

(73) Assignee: SEIKO LTD., Kawasaki-Shi, Kanagawa (JP)

( * ) Notice: Subject to any disclaimer, the term of this patent is extended or adjusted under 35 U.S.C. 154(b) by 15 days.

(21) Appl. No.: 14/575,470

(22) Filed: Dec. 18, 2014

(65) Prior Publication Data

US 2015/0174781 A1 Jun. 25, 2015

(30) Foreign Application Priority Data

Dec. 19, 2013 (JP) ..... 2013-262107
Dec. 19, 2013 (JP) ..... 2013-262108
Jul. 17, 2014 (JP) ..... 2014-146848

(51) Int. Cl.
*B26D 7/18* (2006.01)
*B26D 7/02* (2006.01)
(Continued)

(52) U.S. Cl.
CPC .. *B26D 7/18* (2013.01); *B26D 1/18* (2013.01); *B26D 1/185* (2013.01); *B26D 1/205* (2013.01);
(Continued)

(58) Field of Classification Search
CPC ..... Y10T 83/7487; Y10T 83/7507; Y10T 83/7493; Y10T 83/2081; Y10T 83/2083; Y10T 83/2092; Y10T 83/2179; Y10T 83/2209; Y10T 83/2211; Y10T 83/2213; Y10T 83/2216; Y10T 83/2218; Y10T 83/494; Y10T 83/5669; Y10T 83/647; Y10T 83/687; Y10T 83/8821; Y10T 83/8822; B41J 11/70; B41J 11/706; B26D 7/025; B26D 7/01; B26D 7/015; B26D 7/02; B26D 7/0675; B26D 7/06; B26D 7/18; B26D 7/32; B26D 1/02; B26D 1/025; B26D 1/03; B26D 1/04; B26D 1/06; B26D 1/065; B26D 1/10; B26D 1/105; B26D 1/11; B26D 1/14; B26D 1/20; B26D 1/25; B26D 5/06; B26D 2007/0018; B26D 2007/0043; B26D 2007/0068; B26D 2007/322; B26D 2011/0053; B26D 2011/0033
See application file for complete search history.

(56) References Cited

U.S. PATENT DOCUMENTS

2004/0112195 A1* 6/2004 Lorenzi ..... B26D 1/09 83/546
2005/0061131 A1* 3/2005 Tamura ..... B26D 7/18 83/681

(Continued)

FOREIGN PATENT DOCUMENTS

JP 3838721 B2 10/2006
JP 2008-142816 A 6/2008

(Continued)

*Primary Examiner* — Phong Nguyen
(74) *Attorney, Agent, or Firm* — Manabu Kenesaka

(57) ABSTRACT

A trimming apparatus trims by cutter blades running from one end of a sheet bundle to the other end thereof, includes a bed surface for the sheet bundle, cutter blades for cutting the sheet bundle supported on the bed surface, a drive device for running the cutting blades from one end of the sheet bundle to the other end thereof, a support member having a support face, and a shift device for moving the support member between a working position for the support member supporting cut sheet dust pieces and a retreating position not to hinder the cut sheet dust pieces from dropping. The shift device displaces the support face from the working position to a retreating position after the cutter blades move at a predetermined distance toward the other end of the sheet bundle from one end thereof.

6 Claims, 15 Drawing Sheets

(51) Int. Cl.

| | |
|---|---|
| ***B26D 1/18*** | (2006.01) |
| ***B26D 1/20*** | (2006.01) |
| *B26D 5/06* | (2006.01) |
| *B26D 7/00* | (2006.01) |

(52) U.S. Cl.
CPC . *B26D 7/025* (2013.01); *B26D 1/20* (2013.01); *B26D 5/06* (2013.01); *B26D 2007/0018* (2013.01); *Y10T 83/2092* (2015.04); *Y10T 83/7487* (2015.04); *Y10T 83/7493* (2015.04)

(56) References Cited

U.S. PATENT DOCUMENTS

2005/0211042 A1* 9/2005 Kikuchi ..... B26D 1/08 83/613
2006/0086220 A1* 4/2006 Kaneko ..... B26D 7/025 83/356.2
2007/0209492 A1* 9/2007 Schmid ..... B26D 5/34 83/33
2007/0269291 A1* 11/2007 Wakabayashi ..... B26D 7/18 412/16
2008/0202302 A1* 8/2008 Hayashi ..... B26D 7/025 83/256
2011/0314981 A1* 12/2011 Furuta ..... B41J 11/0065 83/81

FOREIGN PATENT DOCUMENTS

| | | | |
|---|---|---|---|
| JP | 4814773 | B2 | 11/2011 |
| JP | 4824613 | B2 | 11/2011 |
| JP | 4881707 | B2 | 2/2012 |
| JP | 5006006 | B2 | 8/2012 |
| JP | 2012-183602 | A | 9/2012 |
| JP | 5063144 | B2 | 10/2012 |

* cited by examiner

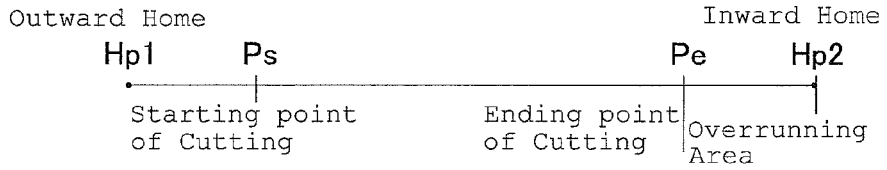
FIG. 14A
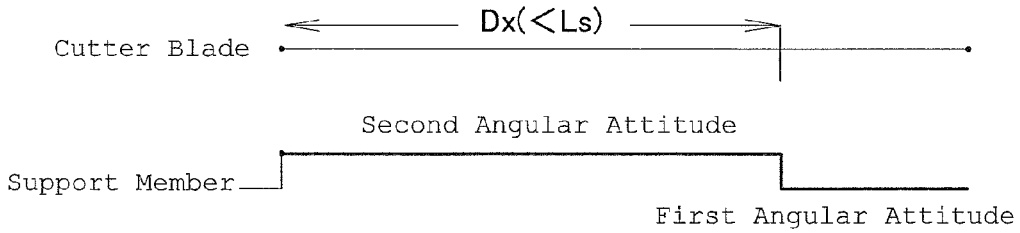
FIG. 14B
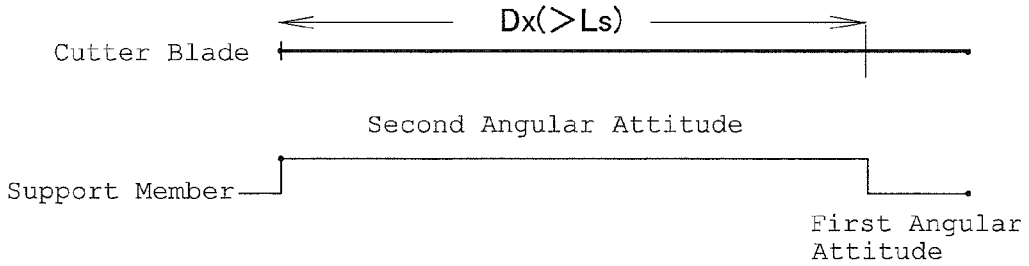
FIG. 14C
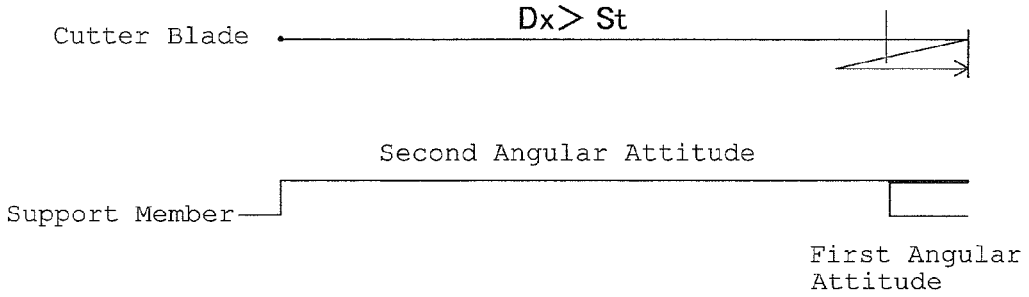
FIG. 14D
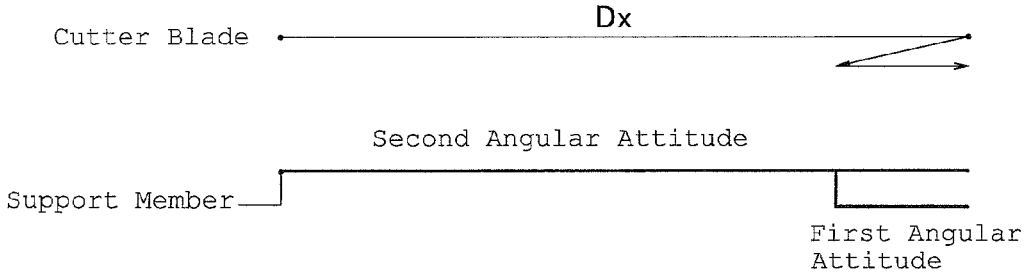

TRIMMER APPARATUS

RELATED APPLICATIONS

The present application is based on, and claims priority from, Japanese Application No. 2013-262107 filed Dec. 19, 2013; No. 2013-262108 filed Dec. 19, 2013; and No. 2014-146848 filed Jul. 17, 2014, the disclosure of which is hereby incorporated by reference herein in its entirety.

BACKGROUND OF THE INVENTION AND RELATED ART STATEMENT

1. Field of the Invention

The present invention relates to a trimmer apparatus for cutting materials to be cut such as a sheet bundle, and is in particular concerned with an improvement of a cutting mechanism of small size, light weight and rich in cutting quality.

2. Description of the Prior Art

This kind of trimmer apparatuses have been known from such a guillotine system cutting mechanism of cutting a sheet bundle placed on a bed plate with a flat shaped guillotine cutter, a disk system cutting mechanism of cutting the sheet bundle gradually from its one end toward the other end while rotating a disc shaped rotating edge, or a travel cutting mechanism of traveling a flat shaped cutter from one end toward the other end of a material to be cut for gradually cutting.

The guillotine system cutting mechanism has been known as a mechanism of setting the material to be cut as the sheet bundle on the bed plate and cutting it with a guillotine cutting blade going down from an upper place to a lower place. This system is known from, for example, Japan patents No.4814773, No.4824613, No.4881707, No.5006006 or No.5063144.

Further, the disk system cutting mechanism has been known as holding under pressure the material to be cut on a bed plate, and traveling the rotating edge from one end of this material to the other end while rotating the rotating cutter blade . This system is disclosed in, for example, Japan patent laid-open No.2008-142816, No.2012-183602(Ogawa), Patents No. No.4814773 or No.3838721 (Furuyama).

In particular, Ogawa Patent and Furuyama Patent disclose such mechanisms of cutting the sheet bundle on the bed plate by such actuations of rotating an upper first rotary cutter blade and lower second rotary cutter blade while moving from its one end to the other end.

Further, the travel cutting mechanism is known as a cutting mechanism with flat-plate cutter blades of moving the material to be cut on the bed plate from one end to the other, for example, in Japan patent laid-open No.2008-100297.

Object of the Invention

The present invention has a subject of provide a trimming apparatus which gives an excellent finished quality of a cut end face trimmed by a cutter blade running from one end to the other of a material to be cut.

SUMMARY OF THE INVENTION

This invention is characterized by disposing a support face separating over a running space of the cutter blade in relation with a bed surface supporting a sheet bundle; movably structuring a support member having this supporting face between a position of holding cut sheet pieces separated from the sheet bundle and a position retreating not to hinder the cut sheet pieces from dropping; and moving positions of the support face during or after cutting the sheet bundle from its one end to the other.

In this case, the bed surface and the support face are placed on the same plane face or on a plane face having a high and low difference, separating from the running space.

BRIEF DESCRIPTION OF THE DRAWINGS

FIGS. 14A to 14D are explaining views of timing of shifting the support members of the support mechanism.

DETAILED DESCRIPTION OF PREFERRED EMBODIMENT

Explanation will be made in detail based on an under shown preferred embodiments.

Figure 1:
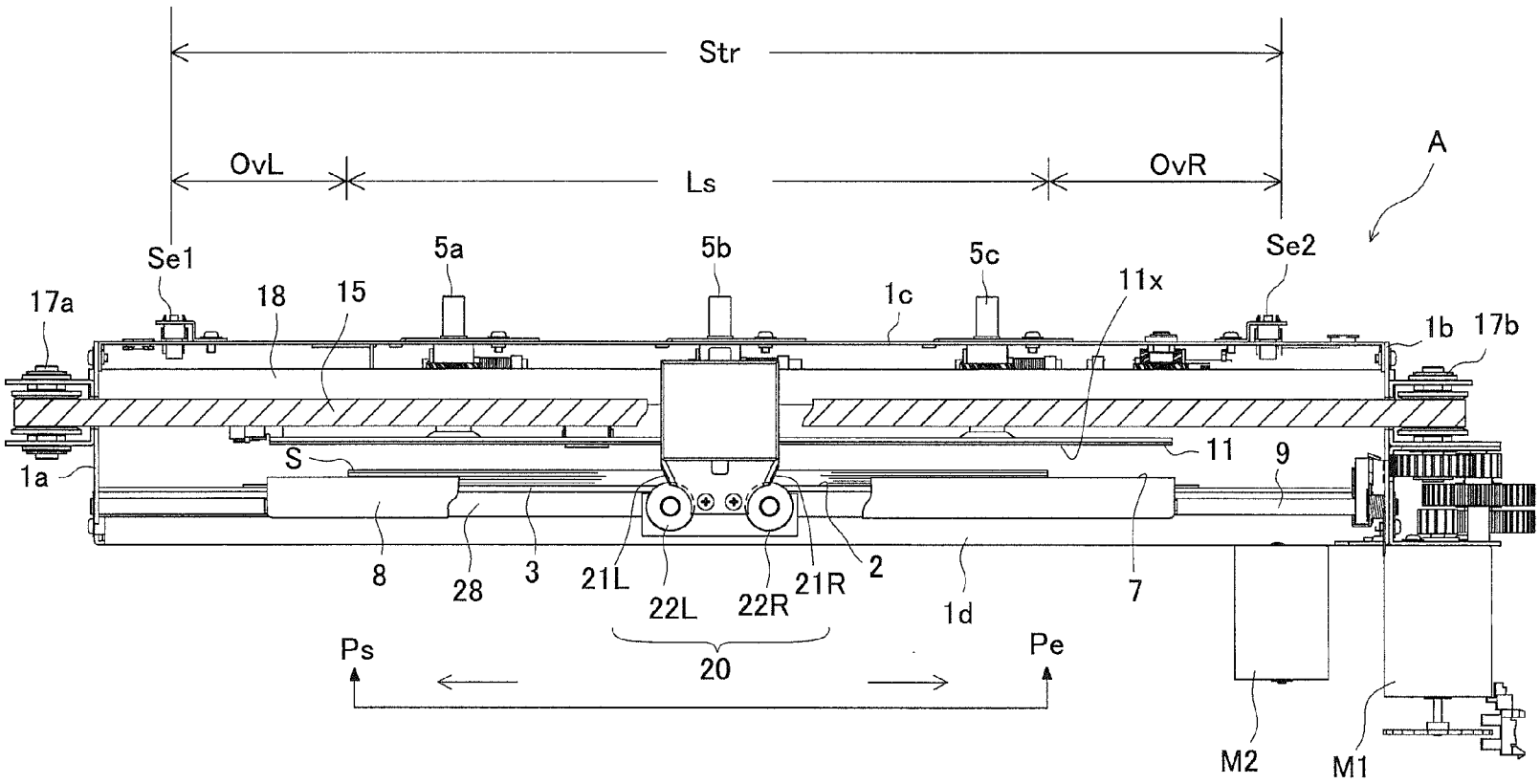
FIG. 1 is an explanatory view of a whole structure of the trimmer apparatus in dependence on the invention.
Figure 2:
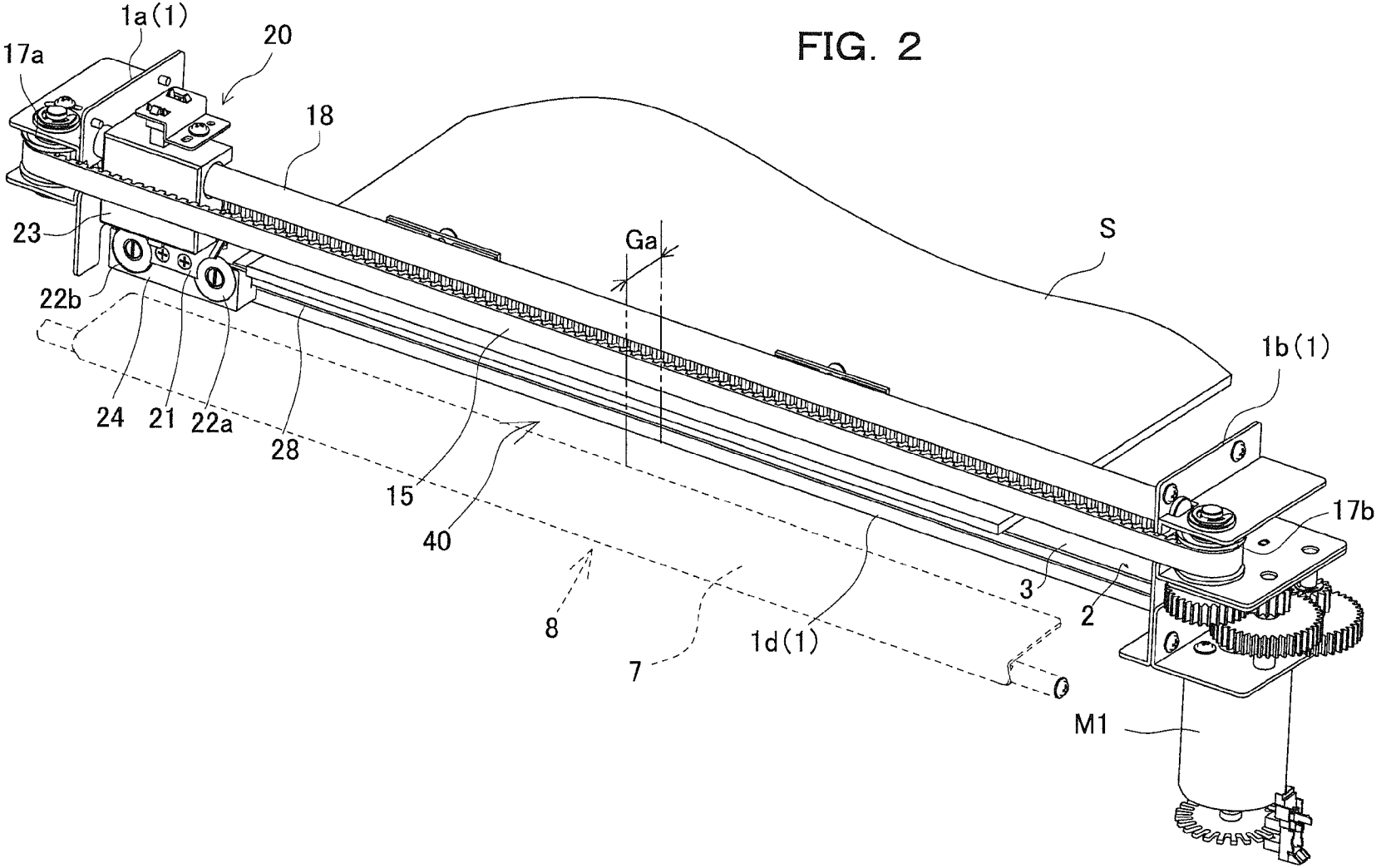
FIG. 2 is a perspective and explanatory view of the cutting mechanism of cutting the sheet bundle in the apparatus of FIG. 1.
Figure 3:
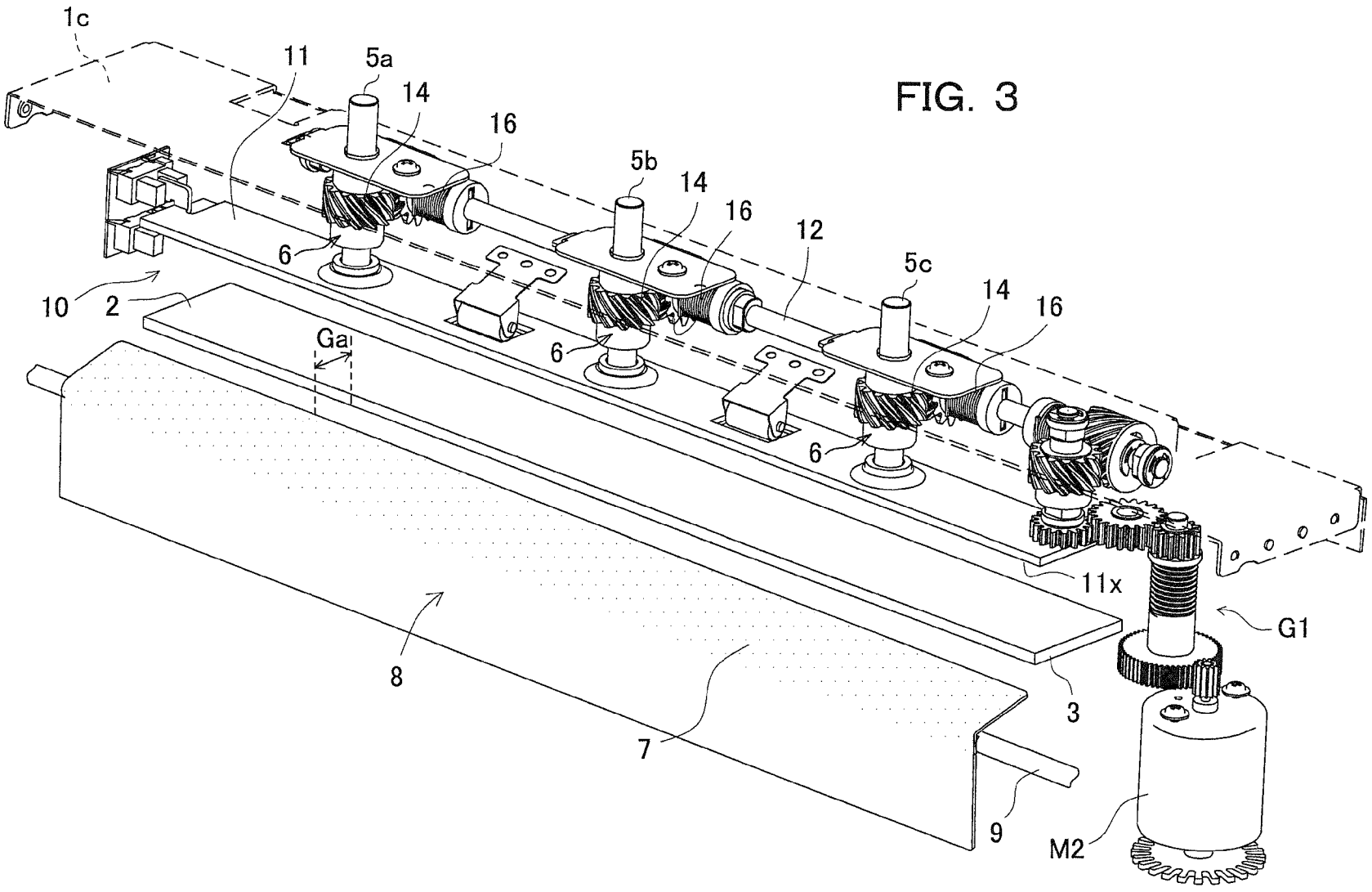
FIG. 3 is a perspective and explanatory view of the sheet pressure mechanism in the apparatus of FIG. 1.

FIG. 1 shows the whole structure of the trimmer apparatus A, FIG. 2 shows a drive mechanism of reciprocating the cutter unit 20 at a predetermined stroke Str, and FIG. 3 shows a press mechanism of holding the material S to be cut at the cutting position.

The illustrated apparatus is composed of an apparatus frame 1, a bed surface 2 of supporting a material S to be cut (referred to as "sheet bundle" hereafter), a carrier guide 8 of guiding the sheet bundle S (paper guide) having been sent from an upstream side onto the bed surface 2, a press mechanism 10 of pressing and holding the sheet bundle S onto the bed surface 2, a cutter unit 20 having cutter blades 21, 22, holder members 23, 24 of supporting the respective cutter blades, and a drive means 40 of reciprocating the holder members at a predetermined stroke Str. At the upstream side of the carrier guide 8, a carrier roller 41 is positioned.

The trimmer apparatus A shown in FIG. 1 is built in with various kinds of paper handling devices for trimming a marginal side of the sheet. For example, the sheets image-formed by an image-forming device are performed with bookbinding through a set copies-justification, piling, binding and folding. The sheet (bundle) through the bookbinding is effected with a trimming finish on oe side or plural sides.

[Sheet Bed]

A sheet support member 3 is composed of a table having a flat support surface 2 and a sheet plate such as a tray. A sheet support member will be called as "sheet bed 3" hereafter.

There are cases, where the apparatus frame 1 is disposed to position the support surface 2 in a horizontal or vertical directions, or to tilt at determined angles in reference to a horizontal direction.

In short, it is possible to dispose the apparatus frame 1 at any angle attitudes unrestrictedly to a paper handling device. In the following, explanation will be made to a case of placing the support surface 2 of the sheet bed 3 in the horizontal direction, and the angle attitudes of the support surface 2 can be disposed at arbitrary attitude in spite of the horizontal direction.

Further, it is possible to form the support surface 2 having an area larger than a sheet size, and adopt a structure of supporting a bridge by disposing a sub-tray at a position adjacent to, for example, the support surface 2. The sheet bed 3 is processed by convenient treatments such as mold process of synthetic resin or folding process of a metal plate.

The above mentioned carrier guide 8 carries the sheet bundle S with the carrier roll 41 at the upstream side onto the bed surface 2. The press means 10 presses and holds the position of the sheet bundle on the bed surface 2. The cutter unit 20 runs from one end Ps to another end Pe of the sheet bundle on the bed surface, and cuts the sheet bundle during this running.

After cutting the sheet bundle, the carrier guide 8 is retreated to a place not disturbing cut pieces from dropping into a dust box (not shown).

The above mentioned apparatus frame 1 is, as shown in FIG. 1, composed of a pair of left and right side frames 1*a*, 1*b*, an upper base frame 1*c* connecting these both frames and a lower base frame 1*d*.

The bed plate 3 having the bed surface 2 is furnished onto the apparatus frame 1. The apparatus of FIG. 1 attaches a plate shaped bed 3 with respect to a pair of left and right side frames 1*a*, 1*b*, and forms the bed surface 2 on its upper surface.

The carrier guide 8 is disposed to an upstream side in carrying direction of the material to be cut (sheet bundle) toward the bed surface 2, and has a guide face 7 positioning with a running gap Ga in relation with the bed surface 3. The carrier guide 8 in FIG. 3 is formed with a plate member having a guide face 7, and is pivoted by a pivot 9 turnably between side frames 1*a*, 1*b*.

According to FIG. 1, explanation will be made to the structure of the bed plate 3 supporting the material S to be cut (sheet or others "b") . The bed surface 2 is formed to be longer than a length Ls (maximum cutting length) in a cutting direction of the sheet to be cut of a maximum size. A running stroke Str of the cutter unit 20 is set to be longer than the maximum cutting length Ls.

Shown OvR and OvL show overrun-lengths (distances) after the cutter unit 20 has cut the sheet bundle S.

"OvR" shows the overrun moving amount when moving (in an outward direction) the cutter unit 20 from a left end Ps of FIG. 1 to a right end Pe.

"OvL" shows the overrun moving amount when moving (in an inward direction) the cutter unit 20 from the right end Pe to the left end Ps.

The running stroke Str of the cutter unit 20 is determined in a relation of an under formula from the maximum cutting length Ls and the overrun lengths (OvR and OvL).

$$Str=(Ls+OvR+OvL) \quad (1)$$

In this case, the moving stroke Str of the cutter unit 20 shows the moving distance of cutting the material S to be cut (sheet bundle) preceding in moving in the outward direction and the moving distance of cutting the material S to be cut (sheet bundle) succeeding in moving in the inward direction.

Accordingly, when cutting the material S to be cut (sheet bundle) by moving only in one direction of the cutter unit 20, the running stroke Str is set in the relation of a following formula.

$$Str=(Ls+OvR) \quad (2)$$

[Press Mechanism]

The above mentioned press mechanism 10 will be explained in accordance with FIG. 3. In the apparatus frame 1 (upper base frame 1*c*), plural support rods 5 (5*a*, 5*b*, 5*c*) are supported, and at these front ends (lower ends in the drawing), a pressure plate 11 is secured.

In the apparatus frame 1, color members 6 are rotatably attached, and these color members 6 are mounted thereon with support rods 5 via screws. Each of the color members 6 is integrally attached with each of passive side screws 14, and is geared with a drive side screw 16.

The drive side screw 16 is mounted on a rotational shaft 12 rotatably attached to the apparatus frame 1. The rotational shaft 12 is connected to a press motor M2 via a reduction gear G1.

With such a structure, the rotational shaft 12 rotates in a normal direction by rotation of the press motor M2. By this rotation, the drive side screw 16 rotates the passive side screws 14, and moves down each of the support rods 5 in a lower direction.

By rotation of the press motor M2 in an opposite direction, each of support rods 5 moves in an upward direction. By up and down actuations of the support rod 5, a pressure face 11*x* of the pressure plate 11 presses to hold the sheet bundle S against the bed surface 2, or releases pressurization.

[Cutter Unit]

Explanation will be made to the cutter unit 20. FIG. 5 shows the whole structure of the cutter unit 20, setting-up and dismantled perspective views, and FIGS. 6A and 6B are the explanatory views of the elementary part.

Figure 5A:
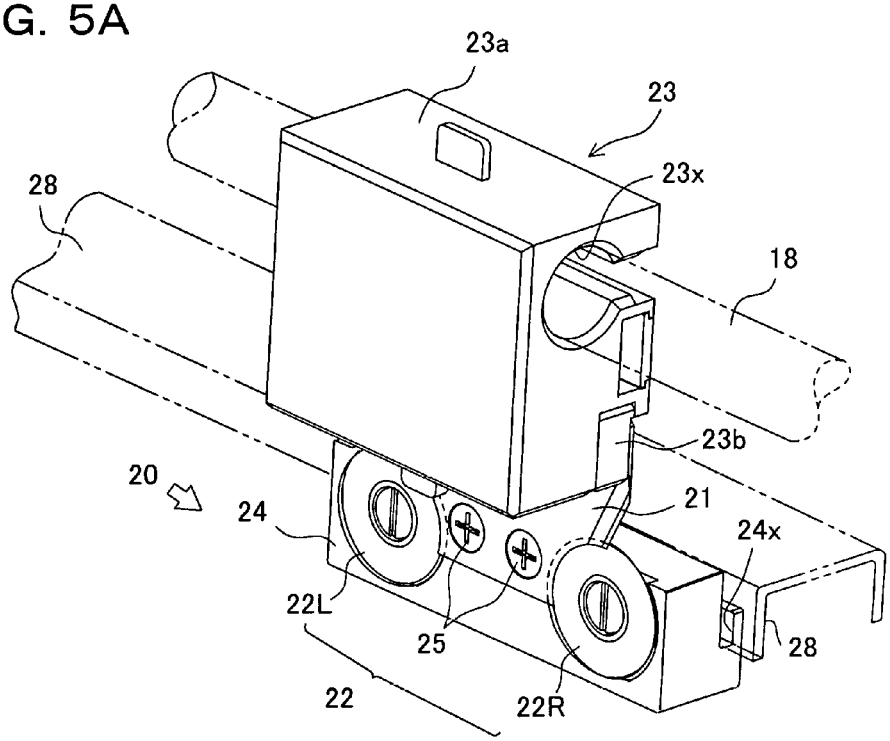
FIGS. 5A, 5B, and 5C are explanatory views of a cutter unit, where 5A is a perspective view showing the whole structure of the cutter unit, 5B is a dismantled and setting up of the cutter unit, and 5C is a central and vertical view of 5A.
Figure 5B:
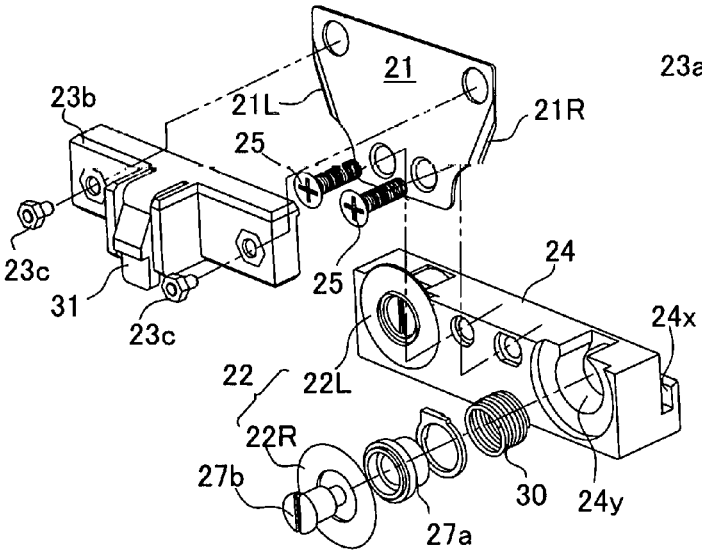
Figure 5C:
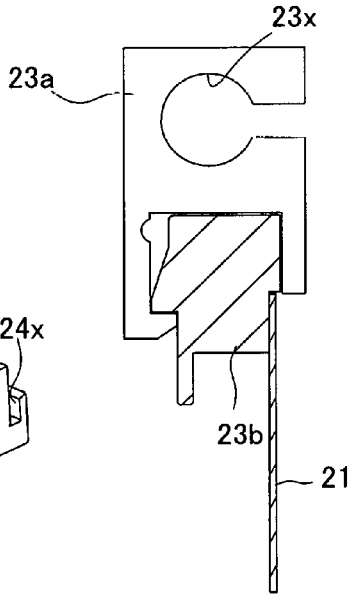
Figure 6A:
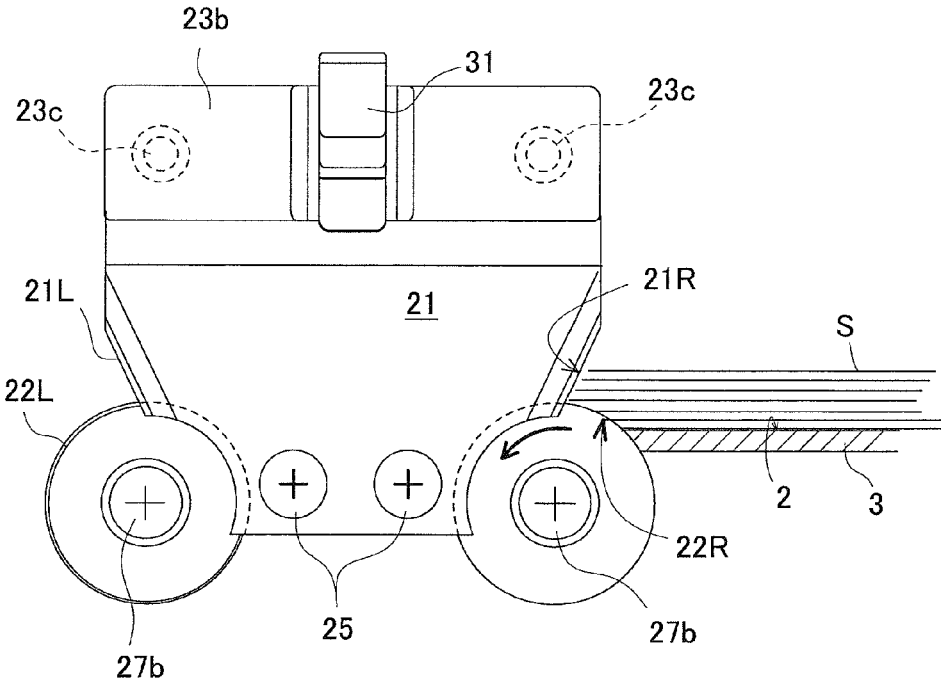
FIGS. 6A and 6B are explanatory views of the cutter unit in the apparatus of FIG. 1, where 6A shows a condition of cutting the sheet (sheet bundle to be cut), and 6B is an explanatory view of the cutting mechanisms thereof.
Figure 6B:
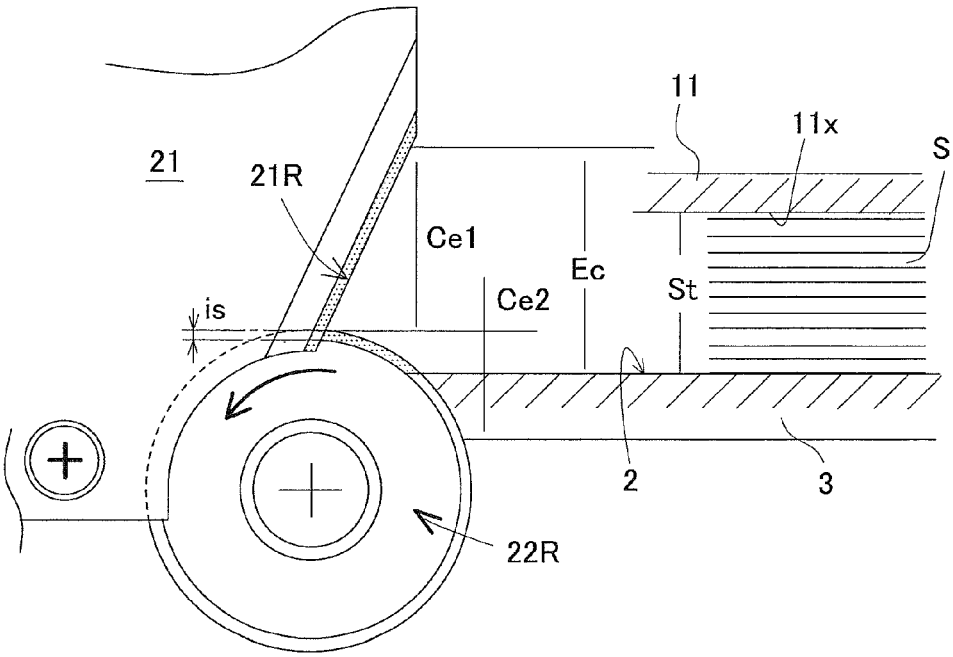

The cutter unit 20 in FIGS. 5A, 5B, and 5C shows the cases of cutting the materials to be cut (sheet bundle) by each action of moving the unit in the outward and inward directions. Therefore, the cutter blades (21, 22) to be explained under have cutting edges (21R, 22R) running in the outward direction and cutting edges (21L, 22L) running in the inward direction.

Accordingly, when the cutter unit 20 is an apparatus structure of cutting the material to be cut by any one of moving in the outward direction or in the inward direction, the cutting edge has only any one of moving directions (21R, 22R) or (21L, 22L).

In FIGS. 5A, 5B, and 5C, the cutter unit 20 is structured with the first cutter blade 21 and the second cutter blade 22, and a first holder member 23 and a second holder member 24 securing these first and second cutter blades.

The first cutter blade 21 is attached to the first holder member 23, and has the cutting edges 21R and 21L for cutting the material S to be cut.

The first holder member 23 is slidably mounted on a later mentioned first running guide member 18. The second cutter blade 22 is attached to the second holder member 24, and has a cutter blade 22R and a cutter blade 22L. The second holder member 24 is slidably mounted on a later mentioned second guide member 28.

One of the above mentioned second cutter blade 22 and second holder member 24 is integrally fixed to the cutter blade 21. A shown one is a connector 25 (fixing screw, welding, rivet or concave-convex connection), and the second holder member 24 is connected to the first cutter blade 21.

As to others, though not shown, it is sufficient that the first cutter blade 21 is directly attached with the second cutter blade 22 via the fixing screw 25 (fixedly or rotatably).

The illustrated first cutter blade 22 is formed with a carbon steel or a cemented carbide, and a cutting edge portion, for example, of about 0.3 mm, is formed with a non-coating layer, and others are covered with fluorine coating.

Thereby, the cutting edge touching the sheet is large in coefficient of friction, it is small in other rake faces, and abrasion resistance is rich. Accordingly, this secures more exactly cutting property, abrasion resistance and corrosion resistance.

[Guide Mechanism]

In reference to FIG. 4, explanation will be made to a guide mechanism slidably supporting the holder members 23, 24. The apparatus frame 1 is vertically provided with a first running guide member 18 and a second running guide member 28 holding the bed surface 2 therebetween.

The first running guide member 18 is composed of a guide rod furnished between side frames 1*a*, 1*b* above the bed surface 2. The second running guide member 28 is composed of a guide rail furnished on the bed surface 3 under the bed surface 2.

The first and second running guide members 18, 28 are parallel each other, and disposed along pre-set cutting lines (not shown) running from one end to the other of the sheet bundle on the bed surface 2.

The illustrated first running guide member 18 is composed of a rod material circle in cross section, while the second running member 28 is composed of a rail material in channel form.

The rod and channel forms in cross section of the first and second running guide members 18, 28 are not specified in shapes as circle, rectangular, L- or U-shapes, but may be determined as arbitrarily.

Figure 4:
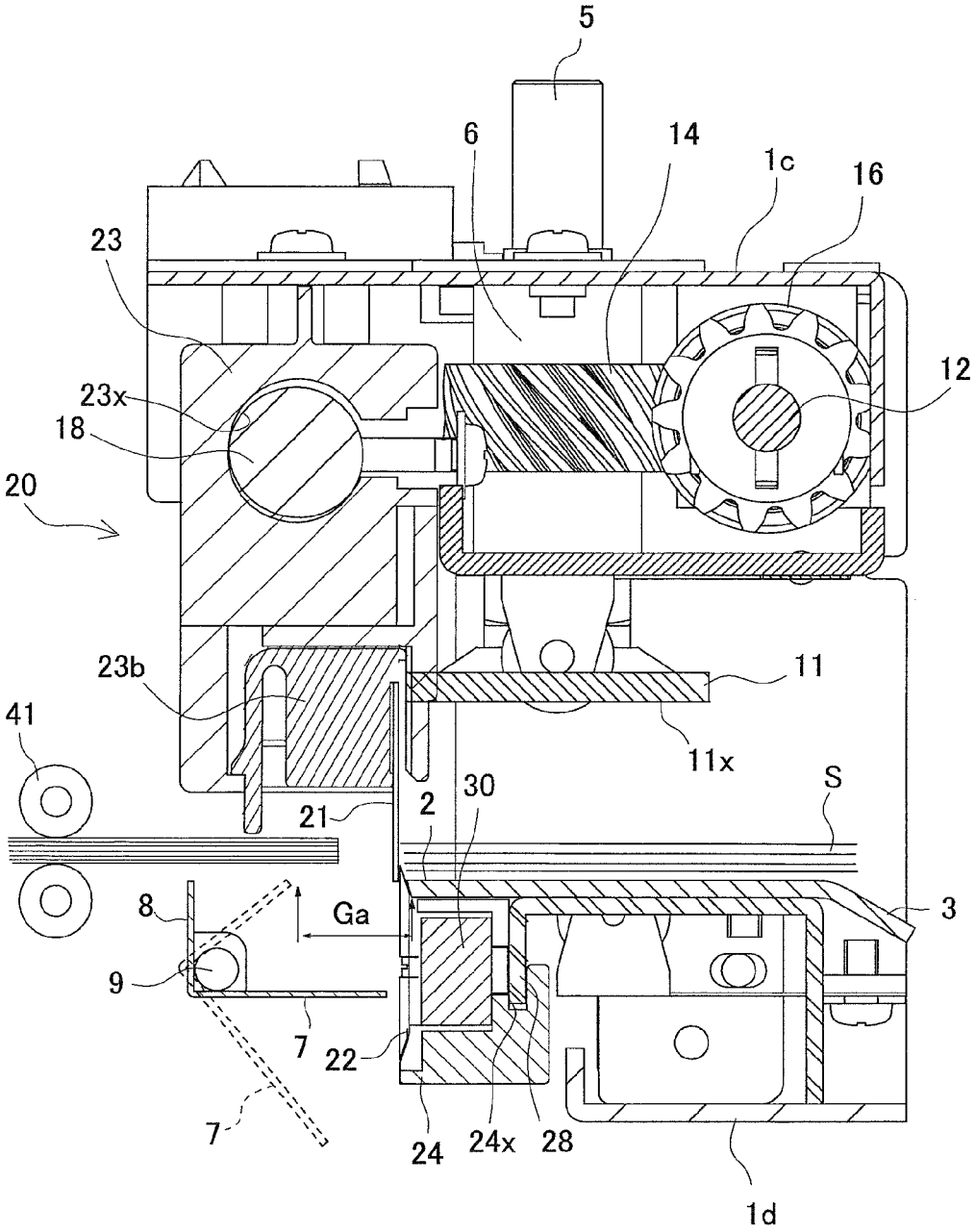
FIG. 4 is a centrally vertical cross sectional view of the apparatus of FIG. 1.

As shown in FIG. 4, the first holder member 23 is fitted in the first running guide member 18 of a rod shape in a fitting hole 23*x*, and is supported slidably in an axial direction.

In the second holder member 24, the fitting groove 24*x* is engaged in the second running guide member 28 and supported slidably in an axial direction.

Following FIGS. 5A, 5B, and 5C, the cutter unit will be explained in regard to a concrete structure. The cutter unit 20 is composed of one sheet of a first cutter blade 21 and two sheets of second cutter blades 22 (22R, 22L). For cutting an upper half part of the sheet bundle S with the cutting edge 21R of the first cutter blade 21, while for cutting a lower half part thereof with the cutting edge 22R of the second cutting blade 22, the first cutter blade 21 and the second cutter blade 22 are formed with such cutting edges continuing in the depth direction (Ec-direction of FIG. 6B) of the material S to be cut (sheet bundle).

The continuing parts of both cutting edges overlap at a crossing point (is) (refer to FIG. 6B), so that a Ce 1-part of the cutting edge 21R of the first cutter blade 21 and a Ce 2 part of the cutting edge 22R of the second cutter blade 22 form an Enable cutting edge Ec.

The relation of the first cutter blade 21 and the second cutter blade 22 is shown in FIG. 6B. In regard to the Enable cutter blade Ce 1 of the first cutter blade 21 and the Enable cutter blade Ce 2 of the second cutter blade 22, their total length (Ec) is formed to be longer than a maximum cutting depth (St: allowable maximum thickness). The cutting length Ce 1 of the first cutter blade 21 is determined to be longer than the cutting length Ce-2 of the second cutter blade 22 (Refer to the under formulae).

$$Ce\ 1+Ce\ 2=Ec \tag{3}$$

$$Ce\ 1+Ce\ 2\geq St \tag{4}$$

$$Ce\ 1>Ce\ 2>0 \tag{5}$$

Ce 1: Enable cutter blade of the first cutter blade 21

Ce 2: Enable cutter blade of the second cutter blade 22

St: Maximum cutting depth

Further, the cutting edge 21R of the first cutter blade 21 is formed with an edge of a linear shape, while the cutting edge 22R of the second cutter blade 22 is formed with an edge of an arc shape. As later mentioned, the second cutting edge 22R is so pivoted as to rotate in an arrow direction (refer to FIG. 6B)) with respect to the first cutter blade 21.

The first cutter blade 21 is formed with the cutting edge 21R for cutting the material S to be cut (sheet bundle) when the cutter unit 20 moves in the outward direction (right direction in FIGS. 6A and 6B) along the first and second guide members 18, 28 and, similarly, this is formed with the cutting edge 21L when the cutter unit 20 moves in the inward direction (left direction in FIGS. 6A and 6B).

The illustrated first cutter blade 21 is formed with a flat-shaped blade, and its right end is formed with the cutting edge 21R in the outward direction, while its left end is formed with the cutting edge 21L in the inward direction.

The first holder member 23 is composed of a slide part 23*a* and a cutting edge securing part 23*b*. The slide part 23*a* is formed with a fitting hole 23*x* to be slidably fitted on the first running guide member 18.

To a cutting edge fixing portion 23*b*, the first cutter blade 21 is fixed with the securing screws 23*c*. The first holder member 23 is mold-formed with a synthetic resin. The first cutter blade 21 is formed with a metal material such as a carbon steel or an alloy steel.

The second cutter blade 22 is composed with the separated two rotating edges of the cutting edge 22R for moving the cutter unit 20 in the outward direction as well as the cutting edge 22L for moving the cutter unit 20 in the inward direction.

The second holder member 24 is formed with a bearing hole 24*y* for pivoting rotatably the first and second rotating blades 22R, 22L, and in this bearing hole 24*y*, an elastic spring 30, a rotating sleeve 27*a* and a fixing pin (screw) 27*b* are rotatably attached.

As having mentioned above, the first holder member 23 is fixed with the first cutter blade 21 at a securing part 23*b* of the cutting edge, and this first cutter blade 21 is secured to a second holder 24 with a connector 25 (such as screw, welding, rivet or concave-convex fitting). Thus, the second holder 24 is rotatably pivoted with a second cutter blade 22 (shown are rotating edges 21R, 212L).

By the way, the elastic spring 30 presses the cutting edge of the second cutter blade 22 to the cutting edge of the second cutter blade 21.

In the embodiment of FIG. 1, the cutting edges (21R, 21L) of the first cutter blade 21 and the cutting edges (22R, 22L) of the second cutter blade 22 are placed respectively in the left and right running directions of the cutter unit 20. This is because when moving the cutter unit 20 in the left and right directions, the sheet bundle S is cut in the respective directions. Accordingly, when the cutter unit 20 is structured to cut only in one direction, it is sufficient to place the cutting edges of the first and second cutter blades in one direction (outward or inward direction).

By the way, in the illustrated apparatus, when supporting the cutter blades 21, 22 to the apparatus, the metal screws 25 fix them to the second holder member 24. Then, the second holder member 24 is structured to make conductive to the guide rail 28 (electrically conductive metal) in the side of the apparatus frame.

Accordingly, static electricity occurring in the first, second cutter blades 21, 22 is earthed from the metal-made screw 25 to the guide rail 28.

As having mentioned above, the first holder member 23 and the first cutter blade 21 as well as the second holder member 24 and the second cutter blade 22 are integrally connected. Therefore, when any one of the first holder member and the second holder member is moved along the first and second running guide members 18, 28, the first and the second cutter blades 21, 22 integrally move from one end Ps of the material S to be cut to the other end Pe, and perform cutting.

[Explanation of Drive Means]

Further explanation will be made to the drive means 40 which moves any one of the first and second holder members 23, 24 from one end of the material S (sheet bundle) to be cut on the bed surface 2 to the other end.

The drive means 40 shown in FIG. 2 is structured with a drive motor M1 and a linear running mechanism reciprocating between one end of the material S (sheet bundle) on the bed surface 2 and its other end.

The apparatus frame 1 is disposed with a drive motor M1 and a pair of pulleys 17*a*, 17*b*, and a timing belt 15 is bridged between the pulleys.

The timing belt 15 is disposed in parallel to the first, second running guide members 18, 28, and one part of the belt is secured to the first holder member 23.

The drive motor M1 is composed of a reverse-inverse motor, and its output rotation shaft is connected to a pulley 17*b* via a reduction mechanism (shown is a gear reduction mechanism).

Accordingly, a linear running mechanism is composed of a pair of pulleys 17*a*, 17*b* and a timing belt 15 bridged thereon. It is also possible to compose the linear running mechanism with a wire and pulley (winding roll) instead of this timing belt 15.

It is possible that the above mentioned linear running mechanism slidably disposes a rack (not shown) on the apparatus frame 1, and connects a first holder member 23 (otherwise, a second holder member 24) on this rack.

A pinion (not shown) gearing with the above rack is secured on the apparatus frame 1 to transmit rotation of the drive motor M1 to the pinion.

It is thereby possible to reciprocate the holder member 23 (or 24) by rotation of the drive motor M1 at a predetermined stroke (Str).

It is possible that the apparatus frame 1 is arranged with a lead screw in parallel with the first running guide member 18, and the lead screw is rotatably bearing-supported to the apparatus frame i.

A fitting portion (not shown) shaped in nut and fitted in a lead screw is connected to a first holder member 23. The lead screw is reciprocally rotated by the drive motor Ml.

Thereby, the first holder member 23 reciprocates at a determined stroke by rotation of the lead screw.

Accordingly, if rotating the running motor M1 normally and reversely, the first holder member 23 connected to the timing belt 15 runs in a normal direction together with the first cutter blade 21 and runs in an opposite direction.

In short, by rotation in the normal direction of the running motor M1, the first holder member 23 carries out the cutting operation in an outward direction at a predetermined running stroke St along a cutting line of the sheet S on the support surface 2, while by rotation in a reverse direction of the running motor M1, the first holder member 23 carries out the cutting operation together with the first cutter blade 21 in the inward direction At this time, the second holder member 24 connected to the first cutter blade 21 and also the second cutter blade 22 perform the cutting operations in the same outward and inward directions.

Reference will be made to a mechanism of supporting pieces of cut and separated paper pieces (waste paper pieces) Cs when cutting with the cutter blades 21, 22 running from one end to the other end of the sheet S held by the support surface 2.

Figure 8A:
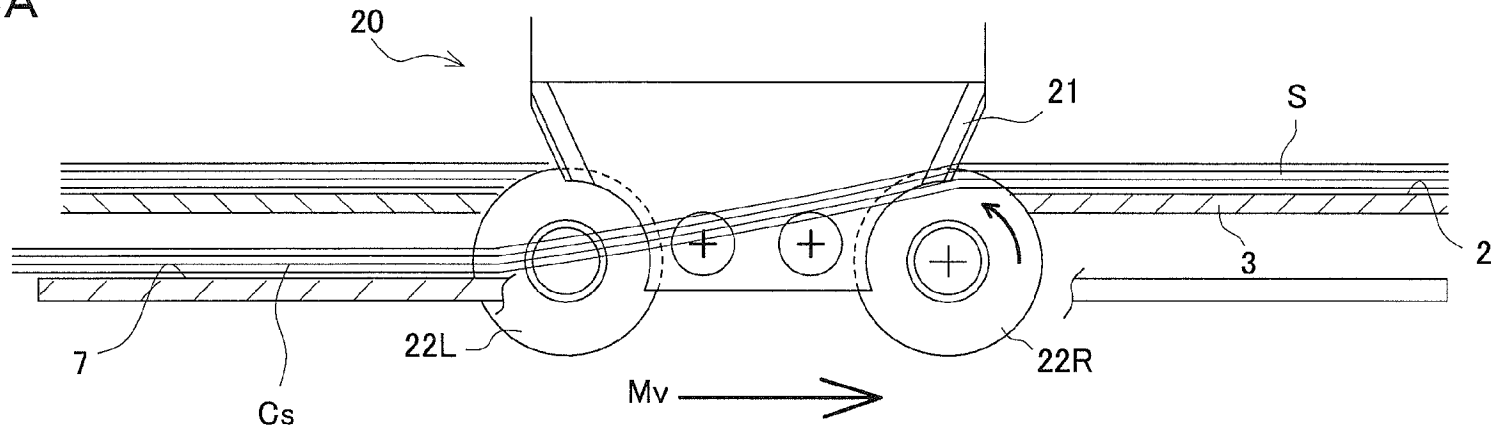
FIGS. 8A and 8B are operation explaining drawings of the support face holding the cut sheet dust pieces in the carrier guide in FIG. 7, where 8A shows a plan view thereof, and 8B shows a cross sectional view.
Figure 8B:
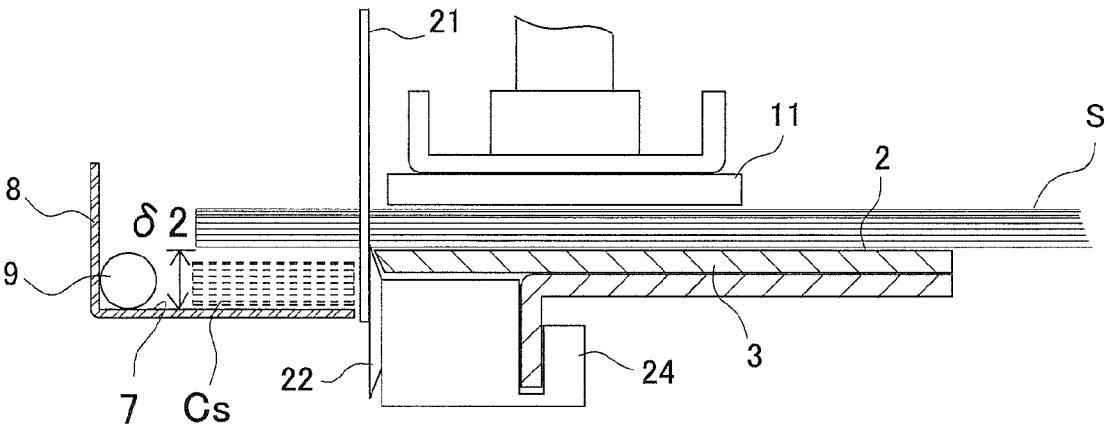

FIGS. 8A and 8B show the model drawings showing the cutting conditions from one end of the sheet S to the other end (from the left to the right directions of the same). In 8A of the same, the cutter blade unit 20 moving in an arrow My direction cuts the sheet S on the support surface 2 at a cutting point Cp. The sheet Cs cut and separated at this time from the sheet S hangs down owing to its own weight as shown.

Owing to hanging of the cut sheet piece Cs, the sheet is distorted and deformed at the cut part. When the sheet is distorted at the cut part Cp engaging with the first cutter blade 21, the cutting line is not linear but distorted, and the cut end is warped in wave.

In the following, explanation will be made to a mechanism of supporting the sheet of the cut part Cp not to be distorted by the sheet pieces cut and hanging down.

[Support Mechanism]

A support mechanism shown in FIGS. 3, 4, 7A, and 7B will be referred to.

At an upstream side adjacent to the support face 2 and sending the sheet, a support member 8 having a support face 7*a* is disposed in the apparatus frame 1.

FIG. 3 is a perspective view showing its disposing relation, and FIG. 4 shows a cross sectional view thereof. As shown in FIG. 3, a rectangular support member 8 longer than the sheet cutting width Ls is placed at an upstream side in a sheet carrying direction of the support face 2. The support member 8 is composed of a bending plate as shown.

The support member 8 has a support face 7*a* supporting a cut end portion of the sheet supported by the support face 2 and a guide face 7*b* guiding the sheet to the support face 2. Under the condition of FIG. 3, the guide face 7*b* is disposed with a layout guiding the sheet S toward the support face 2.

Under the condition of FIG. 4, the support face 7*b* is disposed with a layout supporting the cut sheet piece Cs cut off from the sheet.

The support member 8 has the above mentioned support face 7*a*, a guide face 7*b* and a pivot 9 at its both end portions. The pivot 9 is turnably borne and supported to left and right side plates 1*a*, 1*b*. The bearing structure may be enough formed with bearing holes in the side of the support member.

[Shift Member]

The support member 8 is provided with a shift means 13 of making it displace to a first angular attitude (dotted line of FIG. 4) and to a second angular attitude (solid line of the same) around a center of the pivot 9. The shift 13 is composed with a drive source SM as a drive motor or solenoid, a transmission mechanism 19 of transmitting action of the drive source to the support member 8 as rotation movement, and a control means 60 (such as control CPU) of controlling the drive source.

The shown drive source (drive motor) SM is a stepping motor, and a driving mechanism 19 is composed of reduction gear lines. Rotation of a rotating shaft 39 of the drive source SM is transmitted to the reduction gear 43 via the transmission gear 43 via a drive belt 42, and to an output gear 46 via sliding clutches (spring clutches) 44 and 45. Rotation of an output gear 46 is transmitted to a sector gear 47 which is integrally provided to a pivot 6.

Figure 7B:
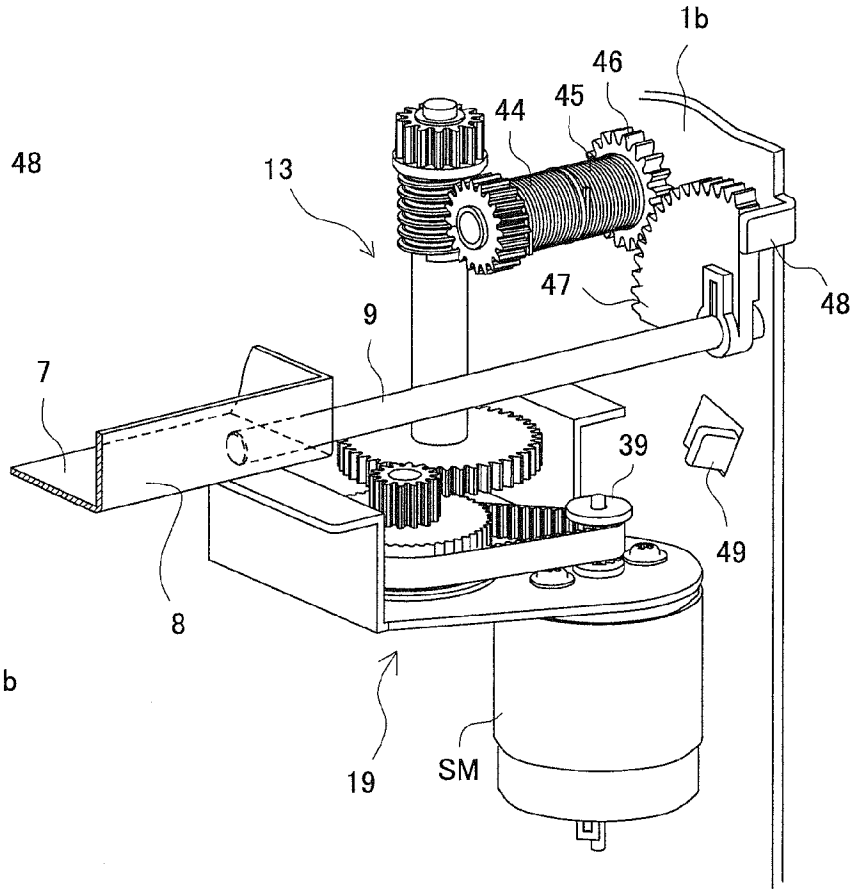
FIGS. 7A and 7 B are perspective and explanatory views of the carrier guide mechanism in the apparatus in FIG. 1, where 7A shows a guide structure guiding the sheet bundle to the bed surface, and 7B shows a guide mechanism supporting dust pieces of the cut sheet.
Figure 7A:
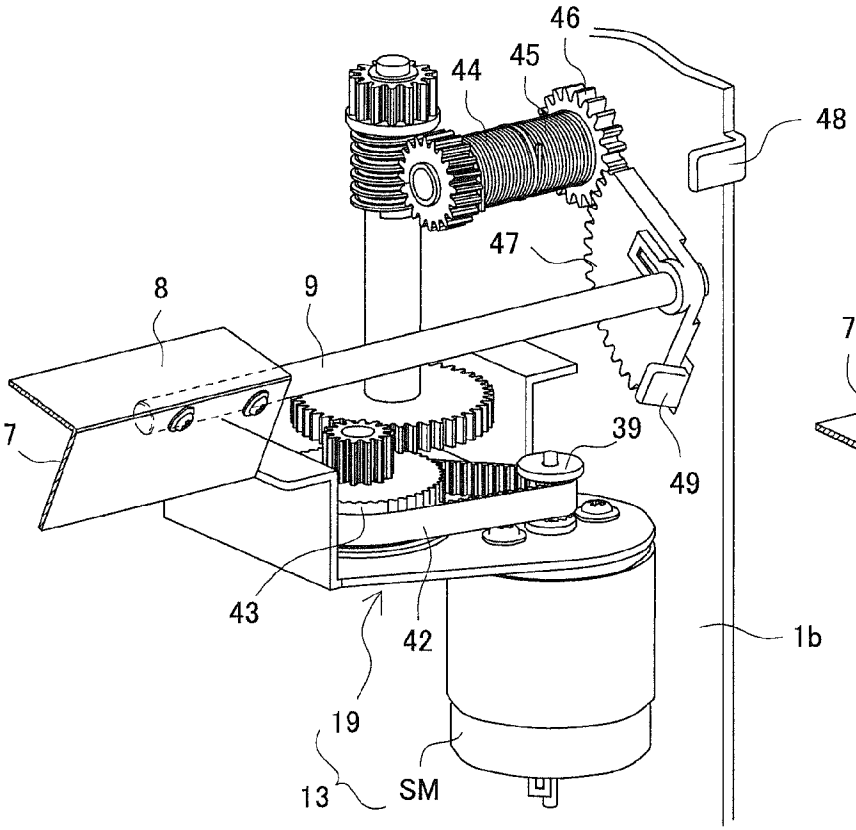

The above spring clutch 44 (first spring clutch) rotates an output gear 46 in a normal direction with respect to the normal rotation of the drive motor SM, and rotates the sector gear 47 at a predetermined angle (counterclockwise direction in FIG. 7A). When the sector gear 47 is engaged with a stopper piece 49 at the first angular attitude, the spring clutch 44 is loosened and slip-rotated, and the output gear 46 and the sector gear 47 stop at angular positions.

The support member 8 under the condition of FIG. 7A guides the sheet sent toward the support face 2 with respect to the guide face 7*b* (called as "first angular attitude" of the support member hereafter If rotating the drive motor SM in a reverse direction, the output gear 46 rotates the sector gear 47 in a counter-clockwise direction of FIG. 7B, and rotates the support face 7*a* at a predetermined angle. If the sector gear 47 is engages with a stopper piece 48 at a second angular attitude, the spring clutch 45 (second spring clutch) is loosened and slip-rotated, and the output gear 46 and the sector gear 47 stop there.

Under the condition of FIG. 7B, the support member 8 supports the sheet pieces cut from the sheet (called as "second angular attitude" of the support member hereafter).

Figure 9A:
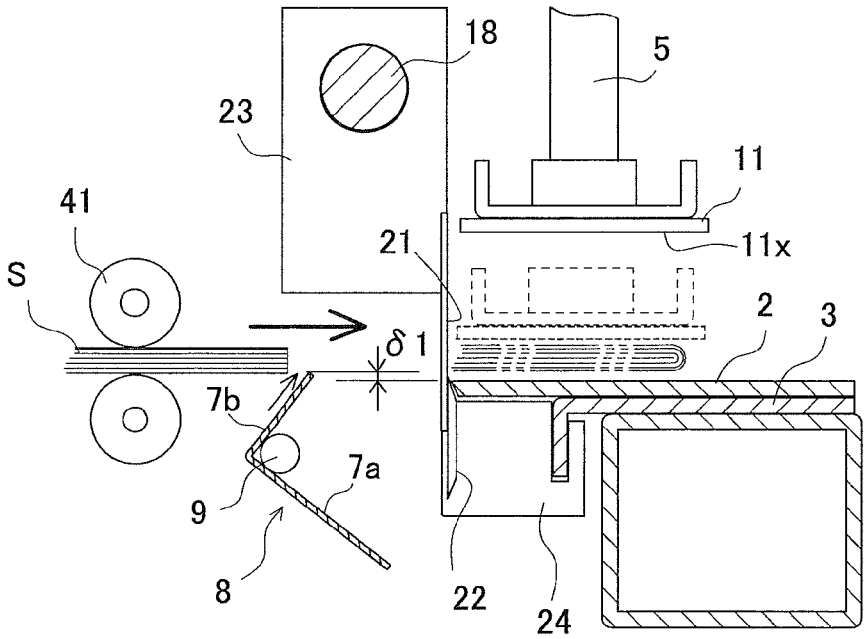
FIGS. 9A and 9B are explanatory views of cutting the sheet bundle in the apparatus of FIG. 1, where 9A shows bringing of the sheet bundle onto the bed surface, and 9B shows setting of the sheet bundle on a predetermined cutting position.
Figure 10A:
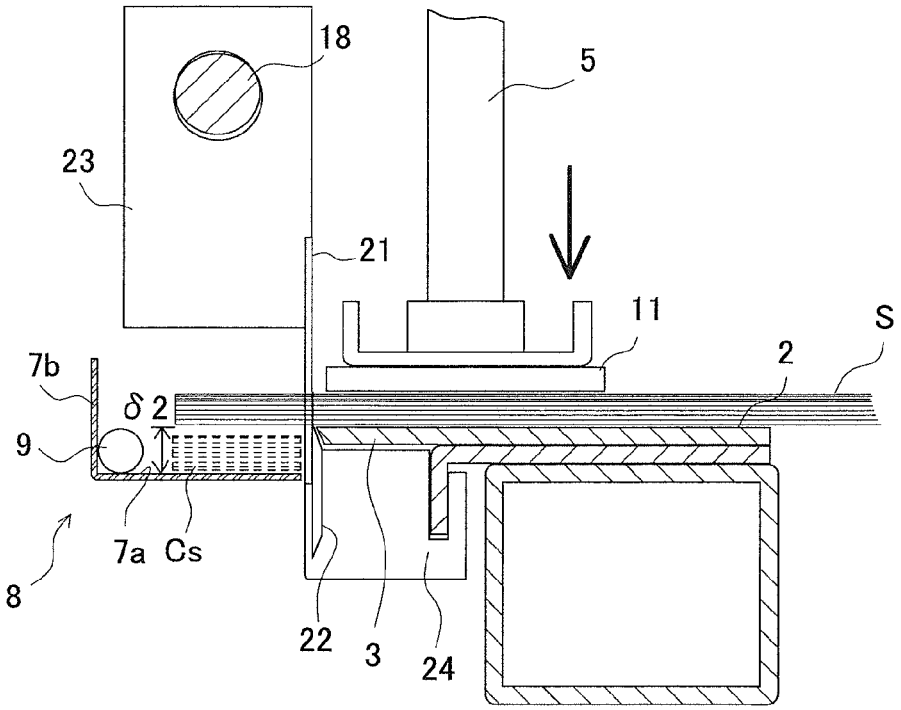
FIGS. 10A and 10B are explanatory views of cutting the sheet bundle, where 10A shows holding under pressure the sheet bundle on the bed surface by means of a press mechanism, and 10B shows cutting the sheet bundle with the cutter blade.

At the above mentioned first angular attitude, the guide face 7*b* is set at a position higher than the support face 2 (refer to difference δ1 of elevation of FIG. 9A), and at the above mentioned second angular attitude, the support face 7*a* is set at a position lower than the support face 2 (refer to difference δ2 of elevation of FIG. 10A).

In short, the guide face 7*b* of guiding the sheet in reference to the support surface 2 is set at the higher position in difference of elevation (in the case of the first angular attitude), while the support face 7*a* for supporting the cut sheet pieces Cs is set at the lower position in difference of elevation (in the case of the second angular attitude).

These guide face 7*b* and support face 7*a* may be at the equal position, but as mentioned above, it is preferable to determine difference of elevation in view of processing precision or rattling of goods.

Next, explanation will be made to performance of the support mechanism in the above mentioned first embodiment.

Figure 13:
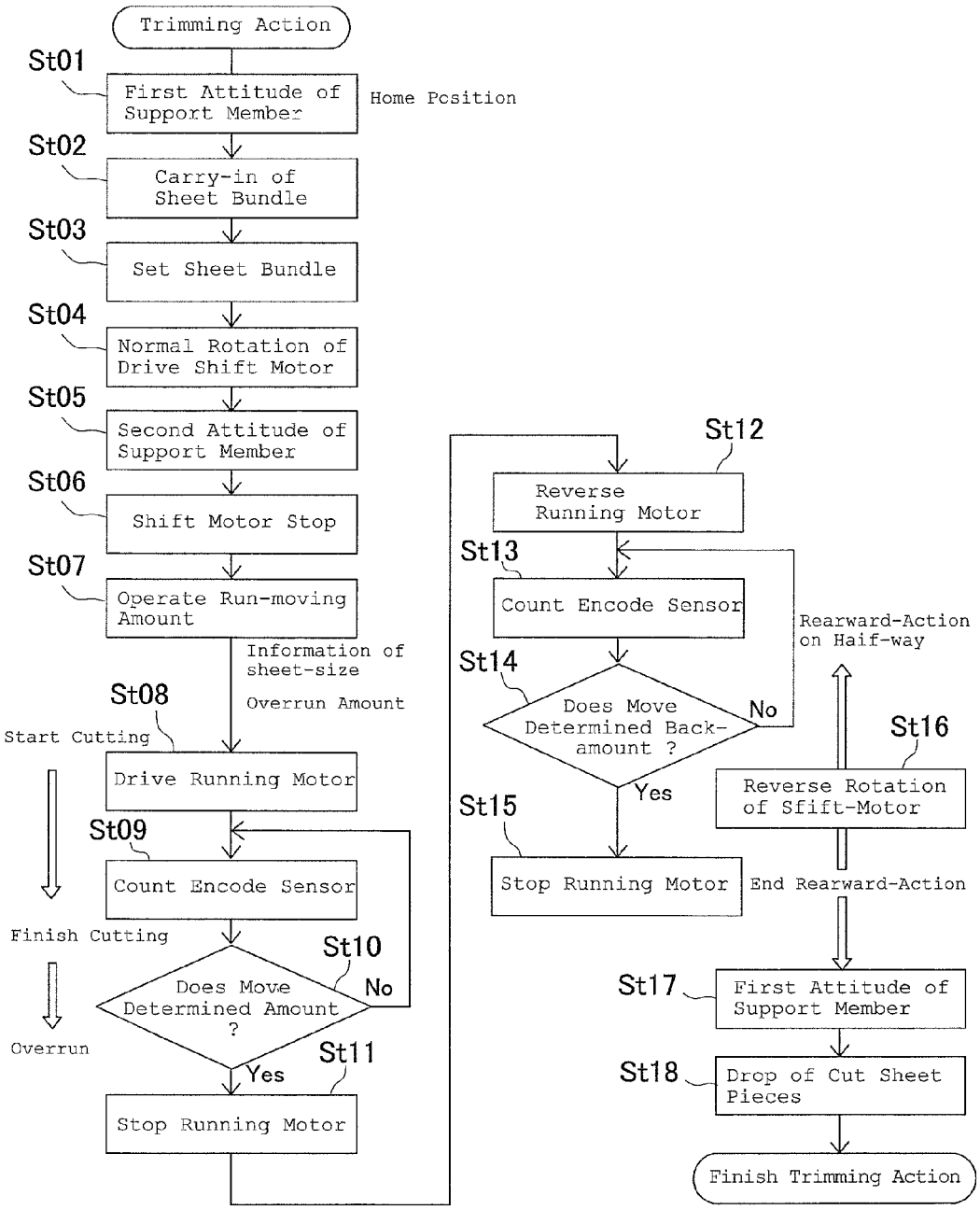
FIG. 13 is a flow chart of cutting operation in the control construction of FIG. 12.

FIG. 13 is a flow chart showing the performance of the support member 8. The above mentioned trimming action will be carried out as follows.

The support member 8 is positioned at a home position by an initializing action (St01). The illustrated home position is set in a first angular attitude (St02).

At the upstream side of the support face 2, a roller, conveyer belt and others are disposed on a carrier mechanism conveying the sheet, and the sheet is conveyed toward the support face 2.

This condition is shown in FIG. 9A, and the sheet sent by the carrier mechanism is guided to the guide face 7*b* and sent to the support face 2. At this time, the first holder member 23 and the cutter blades 21, 22 wait at the outside of an area. The support member 8 is held at the first angular attitude.

The sheet bundle sent to the sheet bed 3 by the convey roller 41 is pressed by a pressure plate 11, when a bent part reaches a position shown with broken lines in FIG. 9A. After a pressing action accomplishes, the pressing plate 11 returns to the waiting position.

Figure 9B:
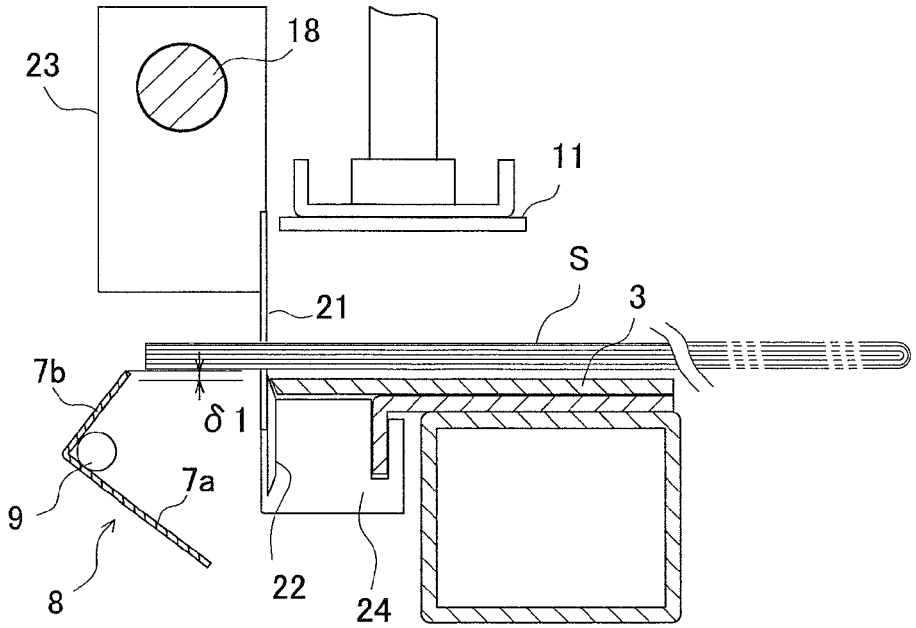

The above mentioned carrier mechanism is disposed with a regulating stopper for positioning the sheet at a predetermined position of the support surface 2, a position aligning means and others. The sheet thus sent from the upstream side is positioned at a predetermined position of the support face 2 along the guide face 7*b* (St03). FIG. 9B shows this sheet setting condition.

When the sheet S is conveyed in the support surface 2, a control means 60 rotates a shift motor SM in a predetermined direction and by a predetermined amount (St04). Then, the support member 8 displaces in a second angular attitude (St05).

The control means 60 stops the shift motor SM, when the support member 8 displaces in the second angular attitude (St06). This state is shown in FIG. 10A.

Before and after the support member 8 displaces from the first angular attitude to the second angular attitude, the control means 60 actuates the sheet pressing mechanism 11 to pressurize the sheet on the support surface and keep the position. This action rotates the shift motor SM and presses the sheet on the support face 2 for keeping the position.

A control means 60 calculates the moving amount of the cutter blade unit 20 from a sheet size information and a pre-set over run amount (Ov) (St07).

Next, the control means 60 rotates the running motor M1 to move the cutter blade unit 20 from one end of the sheet toward the other end (St08). This moving amount detects a rotation amount from en encode sensor of an encoder 50 disposed on a rotation shaft of the running motor M1. FIG. 10A shows a condition of cutting half-way the sheet.

The pieces Cs then cut from the sheet are held on a support face 7*a* as shown in FIGS. 8A and 8B. As shown, the pieces Cs cut from the sheet S on the support face 2 are held on a support face 7*a*, and do not hang down.

At this time, between the support face 2 and the support face 7*a*, a difference δ is defined, and this difference of elevation is determined to such a degree that the cut parts of the sheet are not distorted. The same 8B is an enlarged view of the cut parts.

The control means 60 judges whether, or not, the cutter blade unit 20 reaches a moving amount previously calculated (St10). This moving amount is determined by a moving amount corresponding to an cutting end of the sheet and a previously set over running amount (excessively moving amount). The control means 60 stops the running motor M1 (St11).

The control means 60 retreats, by a determined over-running amount, the cutter blade unit 20 which exceeds a cut finishing position Pe. There are such cases that the cut paper pieces are kept between the cutter blades and moved as they are, and if such moving happens, the cutting actuation thereafter may often causes and invite erroneous actions as jamming. Therefore, this retreating movement is to prevent such cases.

Figure 10B:
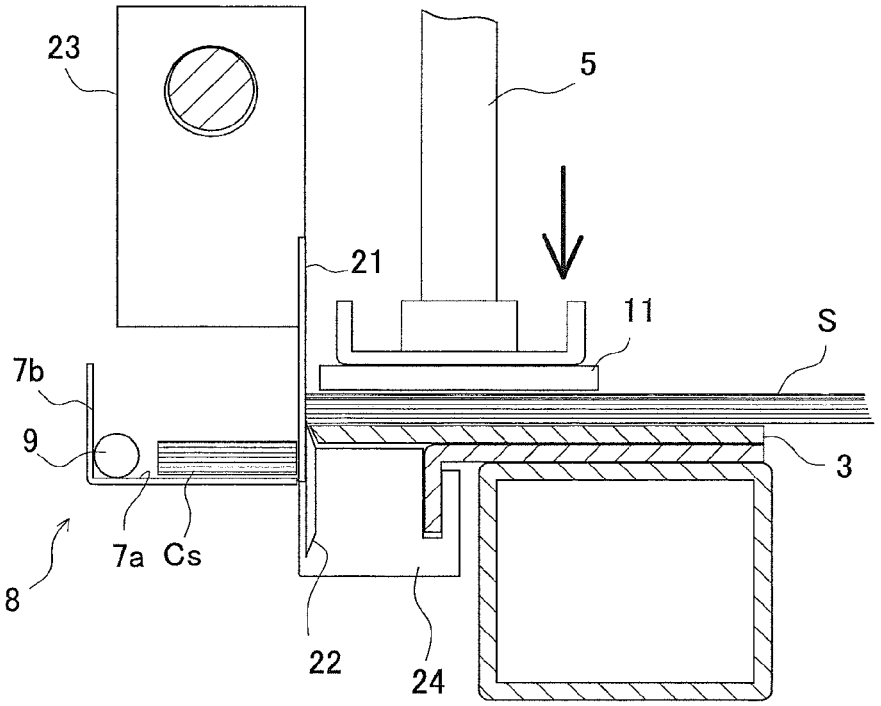
Figure 11:
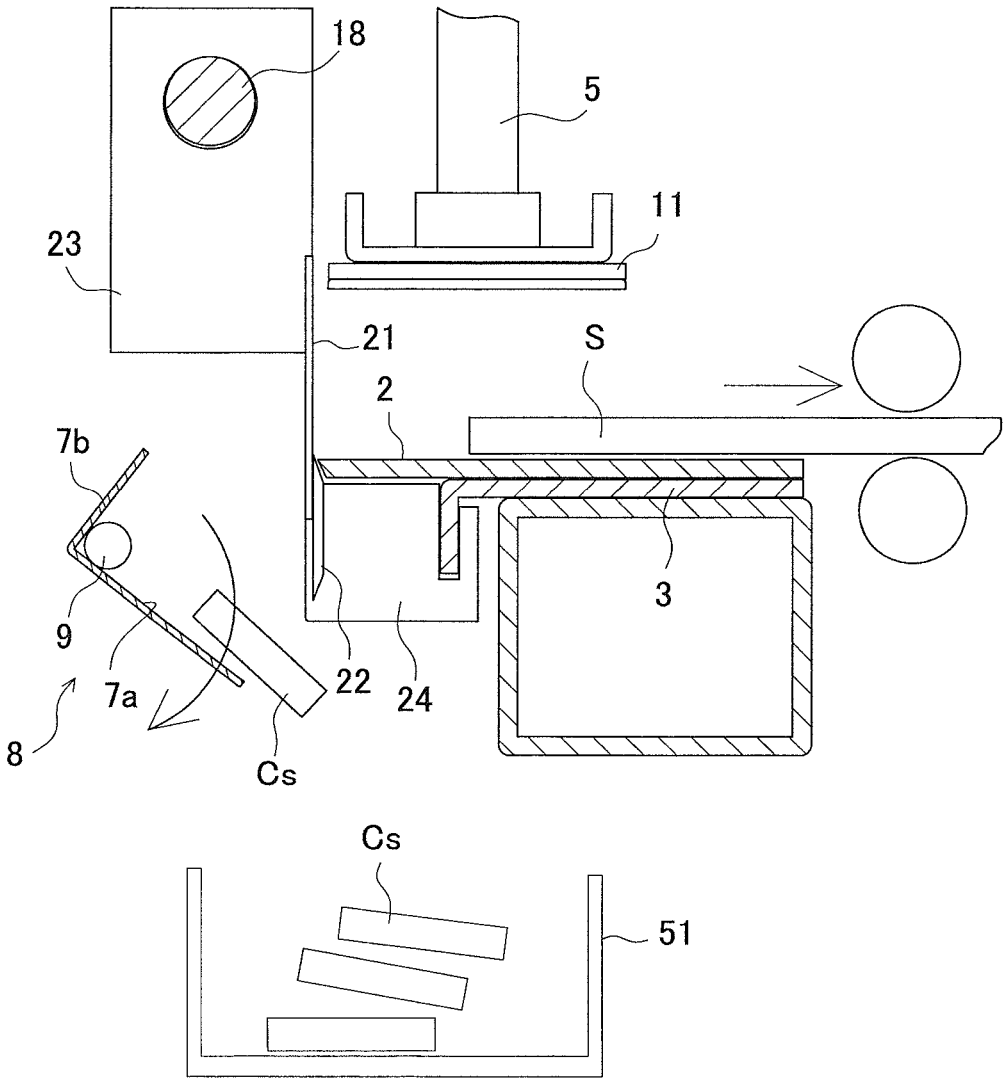
FIG. 11 is condition explaining of cutting the sheet bundle, showing storing of cut sheet pieces into a storing box.

Then, under the condition of FIG. 10B where the cut pieces Cs are supported on the support face 7*a*, the cutter blade unit 20 retreats from the over-run position toward a cutting ending position Pe. The cut pieces Cs caught by the cutting edge and brought away retreat to move in an opposite direction to the caught direction.

Together with it, owing to friction between the support surface 7*a* and the cut piece Cs, the sheet front end gets out from the cutting edges 21, 22, and drops.

The control means 60 rotates the shift motor SM in an opposite direction (reverse direction) (St16) on the way of retreating the cutter blade unit 20, otherwise after finishing retreat (St16).

By rotation of this shift motor SM, the support member 8 changes from the second angular attitude to the first angular attitude (return to the home position; St17). The cut paper pieces Cs drop from the support face 7*a* to the lower dust receiving box 51 (St18).

[Control Structure]

Further explanation will be made to the control structure where the above mentioned sheet trimming apparatus A is built in a post-treating apparatus C of an image forming apparatus B for performing a finish treatment by trimming the post-treatment such as bookbinding.

Figure 12:
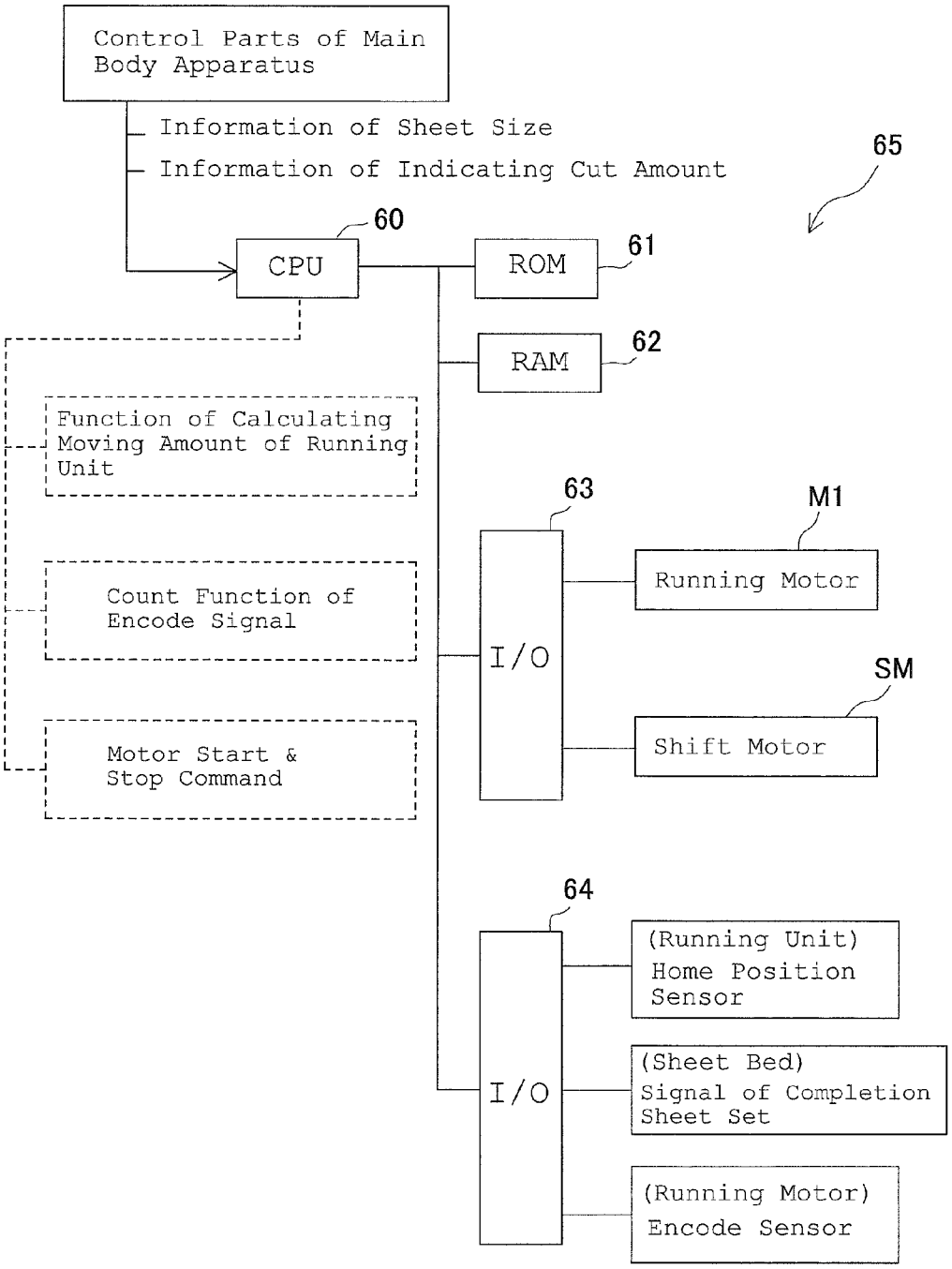
FIG. 12 is an explanatory view of a control construction of the trimmer apparatus in FIG. 1.

As shown in FIG. 12, a sheet trimming apparatus A has a control apparatus 65 comprising a central processing unit (CPU) 60, read only memory (ROM) 61, random access memory (RAM) 62, output port 63 and input port 64.

ROM 61 is stored with a control program, and RAM 62 is stored with rotational speed such as a running motor M1 and a shift motor SM. At the same time, RAM 62 is memorized with an over-run amounts (OvR, OvL) different in response to sheet sizes, or an over-run amounts (OvR, OvL) constant in spite of sheet sizes.

Further, an output port 66 is connected with the above mentioned running motor M1 and shift motor SM. The input port 64 is connected with such sensors as position sensors Se1, Se2 of the first holder member 23, and an encoder sensor Se3 of the running motor M1, and a position sensor Se4 of the support member.

Each of the parts connected via buses is controlled in accordance with the control program stored with CPU 60 in ROM 61.

CPU 60 has a serial interface function, performs a serial communication with CPU of a post-treatment apparatus (called as "apparatus of the main body"), and controls each of the parts by signals from the main body apparatus.

In the above mentioned embodiments, for setting the sheet on the support surface 2, a support member 8 is positioned at a first angular attitude, and after setting, the support member is positioned at a second angular attitude.

After starting to cut the sheet and moving at a determined distance (Dx), the support member 8 is displaced to the first angular attitude. Explanation will be made to a timing of displacing the support member 8 from the second angular attitude to the first angular attitude. Such a timing is sufficient to adopt from any one of the following cases.

(Case 1)

On the way of cutting the sheet S and before finishing this cutting, when the cutter blade unit 20 moves by a predetermined moving amount Dx, the support member 8 is displaced from the first angular attitude to the second angular attitude. This condition is shown in FIG. 14A.

The cutter blade unit 20 starts to move from a home position Hp1 (inward home position, and similar in the following), and starts to cut at a cutting starting point Ps. Before starting this cutting, the support member is positioned at the first angular attitude.

By the way, the moving amount Dx is determined in response to a distortion degree of the cut part by hanging of the cut sheet pieces separated from the sheet.

(Case 2)

When the cutter blade unit 20 passes the cut-finishing point Pe of the sheet, and overruns by a fixed amount, the support member 8 is displaced from the second angular attitude to the first angular attitude. This state is shown in FIG. 14B.

The cutter blade unit 20 finishes the sheet-cutting, and after then, it overruns by a predetermined amount, and reaches a home position Hp2 in an inward home position Hp2, and stops. At this time, the support member 8 is displaced.

(Case 3)

After the cutter blade unit 20 overruns by the fixed amount from a cut-finishing point P, and on the way of rearward moving (back feeding) toward a cut-ending point Pe, the support member 8 is displaced from the second angular attitude to the first angular attitude. This condition is shown in FIG. 14C.

After the cutter blade unit 20 displaces the support member 8, it feeds back till a cut-finishing point Pe, and after then, it again moves in the forward direction to the inward home position Hp2 and stops.

(Case 4)

After the cutter blade unit 20 overruns by the fixed amount from a cut-finishing point Pe, and after it moves rearward (back feeding) toward the cut-ending point Pe, the support member 9 is displaced from the second angular attitude to the first angular attitude. This condition is shown in FIG. 14D).

After the cutter blade unit 20 displaces the support member 8, it again moves in the forward direction, it again moves in the forward direction to the inward home position Hp2 and stops.

[Structures of Image Forming Apparatus and Post-Treatment Apparatus]

At the downstream side of an image forming apparatus B shown in FIGS. 5A, 5B, and 5C, a post-treatment C is connected, and image-formed sheets are performed with the set justification in bundle, and the bundle performed sheets are bound with staples, adhesive tapes and pastes and treated with book-binding.

The sheet bundle after bookbinding is passed through a cutting regularity of the above mentioned trimmer apparatus A and housed into a waste paper stacker.

Then, an inlet path 101 is provided, communicating with a sheet outlet 100 of the image forming apparatus B, and an accumulating tray 103 is placed at the downstream side of a sheet outlet 102 of this inlet path 101. This tray 103 is provided with a switch back roller 104 sending the sheet before and behind in the sheet outlet direction and a rear end- regulating member 105 regulating the rearward end of the sheet.

The above switch back roller 104 carries the sheet from the outlet 102 to the tray front end side, and after the sheet rear end advances on the tray, the switch back roller 104 moves the sheet in a direction opposite to the sheet outlet, and knocks the regulating member 105 with its rear end, and positioned.

The above accumulating tray 103 is furnished with a rear end pushing member 106 for discharging the accumulated sheet bundle to the downstream side. By the way, the accumulating tray 103 is furnished with a side adjusting member (not shown) for positioning and adjusting an orthogonal direction with sending the sheet advancing from the sheet discharging outlet 102.

Therefore, the sheet discharged from the sheet outlet 102 is conveyed on the tray, and accumulated into a bundle shape under a condition being regulated by the regulating member 105. After then, the sheet bundle is conveyed to the downstream by the rear end pushing member 106 under a condition where the rear end regulating member 105.

At the downstream of the above accumulating tray 103, a bookbinding route 107 is continued, and in this route, a center binding stapler 108 is disposed. Further, the bookbinding route 107 is furnished with a stopper 109 for engaging a front end of the sheet bundle.

Therefore, the sheet bundle accumulated on the tray 103 is moved to the bookbinding route 107 by a rear end pushing member 106, and its front end is bound by the stapler under a condition of being engaged by the stapler.

As having stated above, the center-bound sheet bundle is caught by the stopper 109. Under this condition, as if bending the sheet bind at its center part (staple binding position), a bending roll 110 and a center bending knife 111 are arranged. This bending roll 110 is composed with a pair of rolls, bends the sheet bundle at its center, and moves it to a sheet discharging path 112 at the downstream side.

By the way, the post-treating apparatus C has been shown in the case of bookbinding with stapler, and it is of course sufficient that the sheet accumulated in bundle is coated at its ends with an adhesive agent and wrapped with a cover sheet, otherwise such a bookbinding is made by a top-paste binding, not binding with the surface cover sheet.

Figure 15:
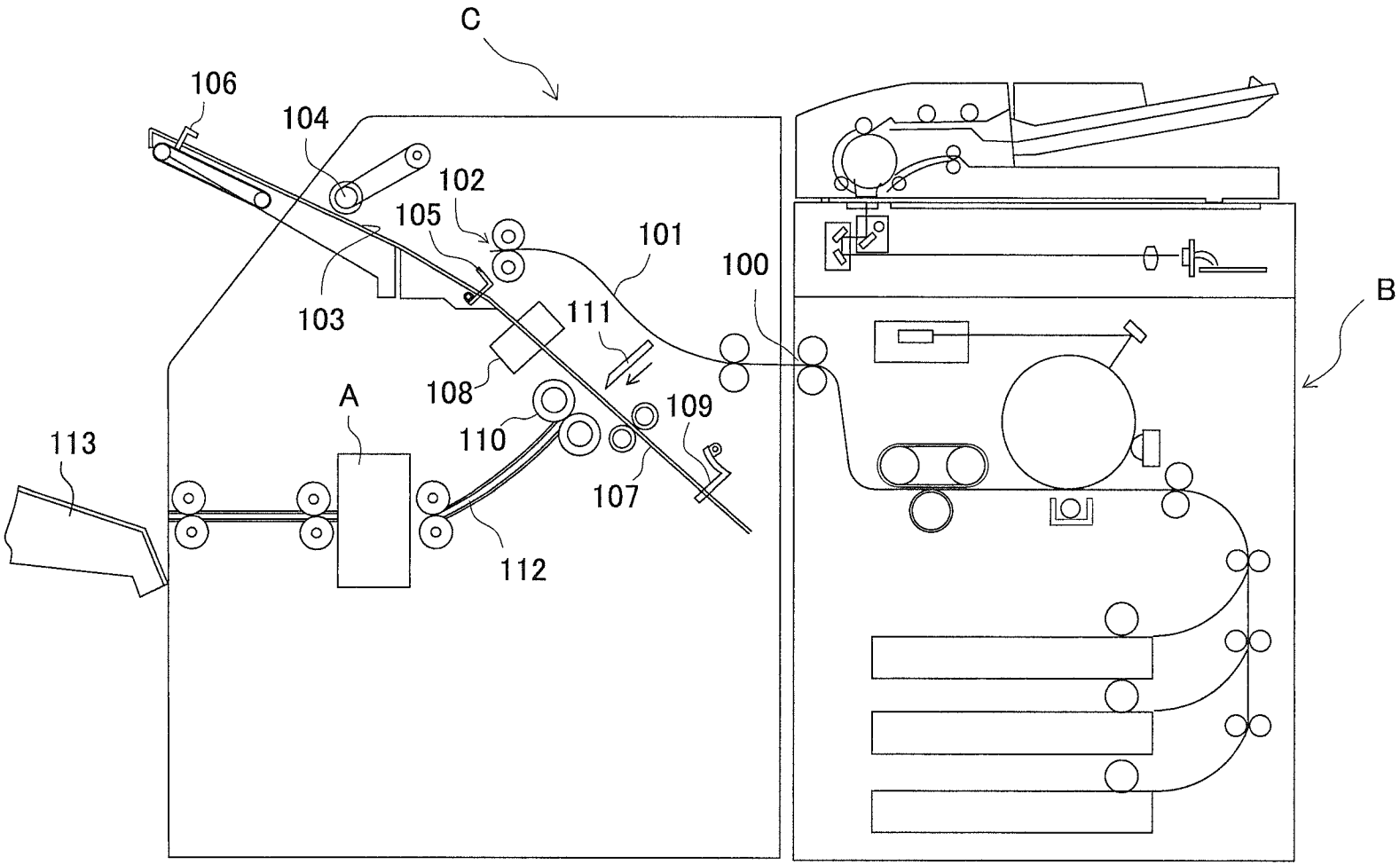
FIG. 15 is a explanatory view of the whole structure of a post-treating apparatus in the present invention.

As shown in FIG. 15, the trimmer apparatus A built in the housing of the post-processing apparatus C is furnished in the path (paper discharging path) 112 of discharging the bent sheet bundle from the upstream side to the downstream side. In the shown apparatus, the trimmer apparatus A is, as a unit, incorporated in the path (sheet discharging path) 112 of sending the sheet bundle from the bending roll 110 into a stuck tray 113.

What is claimed is:

1. A trimming apparatus which carries out trimming by cutter blades running from one end of a sheet bundle to the other end thereof, comprising:

a bed plate having a bed surface for supporting a sheet bundle, cutter blades for cutting the sheet bundle supported on the bed surface, a drive means for driving the cutting blades from one end of the sheet bundle to the other end of the sheet bundle, a support member horizontally spaced apart from the bed plate, leaving a running distance for passing the cutter blades in relation with the bed surface, the support member including a support face for supporting a cut end portion of the sheet bundle and a guide face for guiding the sheet bundle onto the bed surface, and a shift means for rotating the support member between first and second rotationally angular attitudes, wherein in the first rotationally angular attitude, the guide face is positioned above and parallel with the bed surface for guiding the sheet bundle onto the bed surface, wherein in the second rotationally angular attitude, the support face is positioned below and parallel the bed surface for supporting the cut end portion of the sheet bundle, and wherein when the support member is rotated between the first rotationally angular attitude and the second rotationally angular attitude, the cut end portion of the sheet bundle is dropped from the support face into a lower dust receiving box.

2. The trimming apparatus as claimed in claim 1, wherein a control means for controlling the shift means, and wherein the shift means displaces the support member between first and second rotationally angular attitudes while the cutter blades move from one end of the sheet bundle to the other thereof, or after having passed the other end of the sheet bundle.

3. The trimming apparatus as claimed in claim 1, wherein the cutter blades are composed of a first cutter blade and a second cutter blade connected each other, and a cutting edge of the first cutter blade and a cutting edge of the second cutter blade make cutting blades continuing in a direction of thickness of the sheet bundle.

4. The trimming apparatus as claimed in claim 1, wherein the support member is provided with a pivot rotatably supported on an apparatus frame, and the shift means is composed of a drive motor and a transmission mechanism converting rotation of the drive motor into rotation of the pivot.

5. The trimming apparatus as claimed in claim 1, further comprising a post treating.

6. The trimming apparatus as claimed in claim 5, where the post treating includes an image forming apparatus.

* * * * *